US006647893B1

(12) United States Patent
Fugitt et al.

(10) Patent No.: US 6,647,893 B1
(45) Date of Patent: Nov. 18, 2003

(54) RACE TRACK ASSEMBLY

(75) Inventors: Gregory A. Fugitt, Willard, MO (US); C. Dwayne Fulton, Osage Beach, MO (US)

(73) Assignee: Osment Models, Inc., Linn Creek, MO (US)

( * ) Notice: Subject to any disclaimer, the term of this patent is extended or adjusted under 35 U.S.C. 154(b) by 0 days.

(21) Appl. No.: 10/172,958

(22) Filed: Jun. 17, 2002

(51) Int. Cl.[7] ..... E01C 5/00

(52) U.S. Cl. ..... 104/69; 104/60; 104/126; 238/10 R

(58) Field of Search ..... 238/10 R, 10 M, 238/10 B, 10 C, 10 E, 10 F; 104/53, 54, 55, 56, 60, 69, 126; 446/444, 446

(56) References Cited

U.S. PATENT DOCUMENTS

| | | | | | |
|---|---|---|---|---|---|
| 2,919,515 | A | * | 1/1960 | Connell | 238/10 R |
| 3,206,890 | A | * | 9/1965 | Freyermuth | 446/446 |
| 3,487,999 | A | * | 1/1970 | Nash | 238/10 R |
| 3,502,332 | A | * | 3/1970 | Wolf | 463/69 |
| 3,542,366 | A | * | 11/1970 | Schocker | 273/108 |
| 4,270,748 | A | * | 6/1981 | Ray | 472/116 |
| 4,898,404 | A | * | 2/1990 | Babcock | 281/15.1 |
| 5,000,715 | A | * | 3/1991 | Johnson | 446/427 |
| 5,203,733 | A | * | 4/1993 | Patch et al. | 446/444 |
| 6,000,986 | A | * | 12/1999 | Kaufman | 446/147 |
| 6,093,079 | A | * | 7/2000 | House | 446/444 |
| 6,328,500 | B1 | * | 12/2001 | Rubio | 404/32 |
| 2002/0195502 | A1 | * | 12/2002 | Delage | 238/10 E |

OTHER PUBLICATIONS

Boy Scouts of America Official Retail Catalog, Leader Edition, p. 9 (2001).
PineCar Pine Car/Sailboat Racer Program Guide (1989).
BestTrack Pinewood Derby Tracks http://www.besttrack.com (no date).
SuperTrack from SuperTimer http://www.supertimer.com/track/supertrack.html (no date).
Derby Race Tracks and Judge III by Indy Products wysiwyg://18/http://indyproducts.com//shop/Tracks.htm (no date).
Piantedos, USA http://www.pinewoodderbytrack.com/ (no date).

* cited by examiner

*Primary Examiner*—Mark T. Le
(74) *Attorney, Agent, or Firm*—Stinson Morrison Hecker LLP; J. David Wharton

(57) ABSTRACT

A race track assembly that can be assembled from a flat folded configuration for use and disassembled to a flat folded configuration for storage. The race track assembly includes a plurality of track sections that can be positioned end-to-end to form a race track. Each track section consists of a main track and two sides that are foldable relative to the main track. A plurality of couplers are also included for coupling the track section together. The race track assembly also includes a plurality of cross braces positioned at spaced intervals along the length of the race track. Each of the cross braces is coupled to a track section in a manner to maintain the sides of the track section in a folded configuration. A plurality of risers are also included for supporting the race track in an inclined position. Each of the risers can be unfolded to a track supporting configuration and folded to a flat storage configuration.

40 Claims, 3 Drawing Sheets

RACE TRACK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates generally to race tracks for small model race cars and, in particular, to race tracks that can be assembled from a flat folded configuration for use and returned to a flat folded configuration for storage.

2. Description of Related Art

Over the last fifty years, wooden car derby races have become very popular amongst Cub Scouts and other youth organizations. Prior to a wooden car derby race, each participant receives a kit containing a block of wood, four nails and four plastic wheels. Based on a set of rules, each race participant (typically with the assistance of a parent) uses these materials to construct a small model race car of specified dimensions that can be gravity powered and run down an inclined race track. If a race participant desires to test the performance of his race car, he must do so on some type of homemade race track and/or on a regulation race track located at a Cub Scout den or other similar location.

A regulation race track for wooden car derby races generally consists of two or more sections of plywood that are connected end-to-end to form the race track. One end of the race track is supported in an elevated position such that the race track slopes downwardly from a start end to a finish end. A starting gate located at the start end of the race track is moveable between a closed position for maintaining the race cars at the start end of the race track and an open position for allowing the race cars to travel toward the finish end of the race track. An electronic timer may also be located at the finish end of the race track to accurately determine the winner of a particular race.

Although a regulation race track is commonly used by organizers of wooden car derby races, its plywood construction makes it heavy, relatively expensive, difficult to assemble, bulky, and hard to store and/or ship. As a result, a race participant typically does not construct a regulation race track in his home for the purpose of testing the performance of his race car. Instead, as mentioned above, he must do so on some type of homemade race track and/or on a regulation race track located at a Cub Scout den or other similar location.

Therefore, an objective of the present invention is to provide a race track assembly that can be used by a race participant for the purpose of testing the performance of his race car. A related objective of the present invention is to provide a race track assembly that is lightweight, relatively inexpensive, easy to assemble, capable of being disassembled into a small amount of space, and easy to store and/or ship.

BRIEF SUMMARY OF THE INVENTION

These and other objectives are met by the race track assembly of the present invention. The race track assembly generally includes a plurality of track sections that can be positioned end-to-end to form a race track. Each track section consists of a main track and two sides that extend along opposite sides of the main track. The sides of each track section are foldable relative to the main track, such that the sides can be unfolded to form the sides of the race track or folded to a flat storage configuration. A plurality of raised centerlines are formed on the upper surface of the main track, each of which serves as a guide for a race car traveling down the race track. Preferably, the track sections are each formed of a lightweight material, such as cardboard or plastic.

The race track assembly also includes a plurality of couplers for coupling the track sections together. In a preferred embodiment, each coupler consists of a coupler panel, hook-type fasteners secured to the top face of the coupler panel, and loop-type fasteners secured to the bottom surfaces of adjacent track sections. In use, the hook type fasteners can be aligned with the loop-type fasteners to couple the adjacent track sections together. Preferably, the hook-and-loop-type fasteners consist of strips of material sold under the trademark VELCRO®.

Also included within the race track assembly are a plurality of cross braces positioned at spaced intervals along the length of the race track. Each of the cross braces is coupled to a track section in a manner to maintain the sides of the track section in a folded configuration. In a preferred embodiment, the cross braces extend transversely between the sides of the track section and includes a pair of slots formed at opposite sides thereof. These slots can be mated with corresponding slots formed in the sides of the track section to maintain the sides in a folded configuration. Preferably, the cross braces are also formed of a lightweight material, such as cardboard or plastic.

The race track assembly additionally includes a plurality of risers for supporting the race track in an inclined position such that the race track extends from a top start end to a bottom finish end. In a preferred embodiment, most of the risers consist of two vertical supports that extend upwardly from a horizontal base. Each vertical support includes slots formed at the upper end thereof, which can be mated with corresponding slots formed in the sides of a track section. Importantly, each of the risers can be unfolded to a track supporting configuration and folded to a flat storage configuration. Preferably, the risers are also formed of a lightweight material, such as cardboard or plastic.

Another riser in the form of a tower is also provided to support the race track in an inclined position. This riser consists of a vertical box having an opening extending therethrough for receiving the upper start end of the race track. The riser also includes a starting gate having tabs that are slideable within slots formed in the side walls of the riser. The starting gate is thus moveable between a closed position for maintaining race cars at the top start end of the race track and an open position for allowing the race cars to travel toward the bottom finish end of the race track. Importantly, this riser can be unfolded and folded like a box between a track supporting configuration and a flat storage configuration. Preferably, this riser is also formed of a lightweight material, such as cardboard or plastic.

The race car assembly of the present invention is thus configured to be easily assembled from a flat folded configuration for use and disassembled to a flat folded configuration for storage. In particular, a race car participant can easily assemble this race car assembly for the purpose of testing the performance of his race car. In addition, the race car assembly can be easily disassembled into a small amount of space for storage and/or shipment to a different location via common shipping methods.

The present invention will be better understood from the following detailed description of the invention, read in connection with the drawings as hereinafter described.

DETAILED DESCRIPTION OF THE INVENTION

Figure 1:
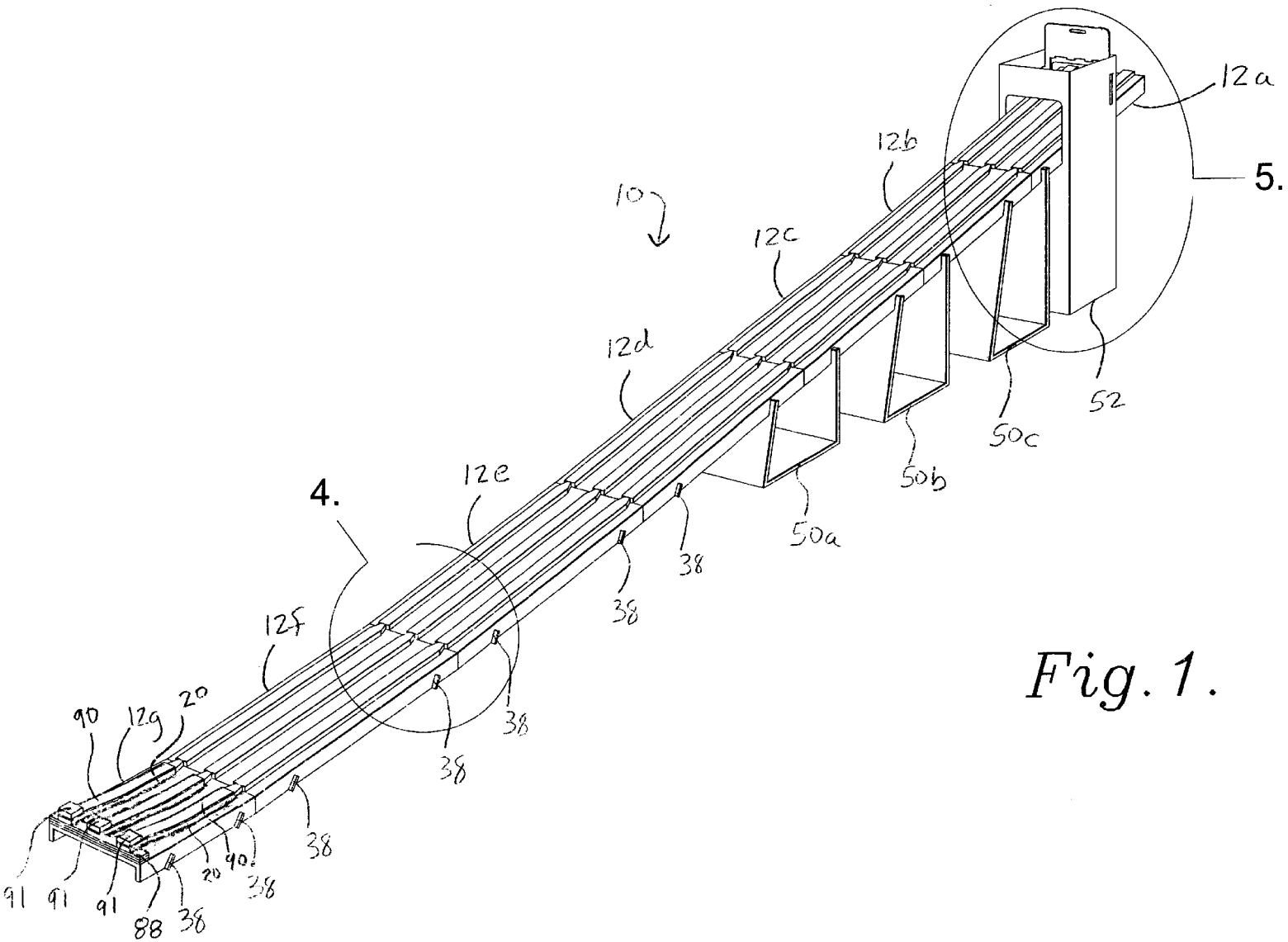
FIG. 1 is a perspective view of a race track assembly in accordance with a preferred embodiment of the present invention.
Figure 2:
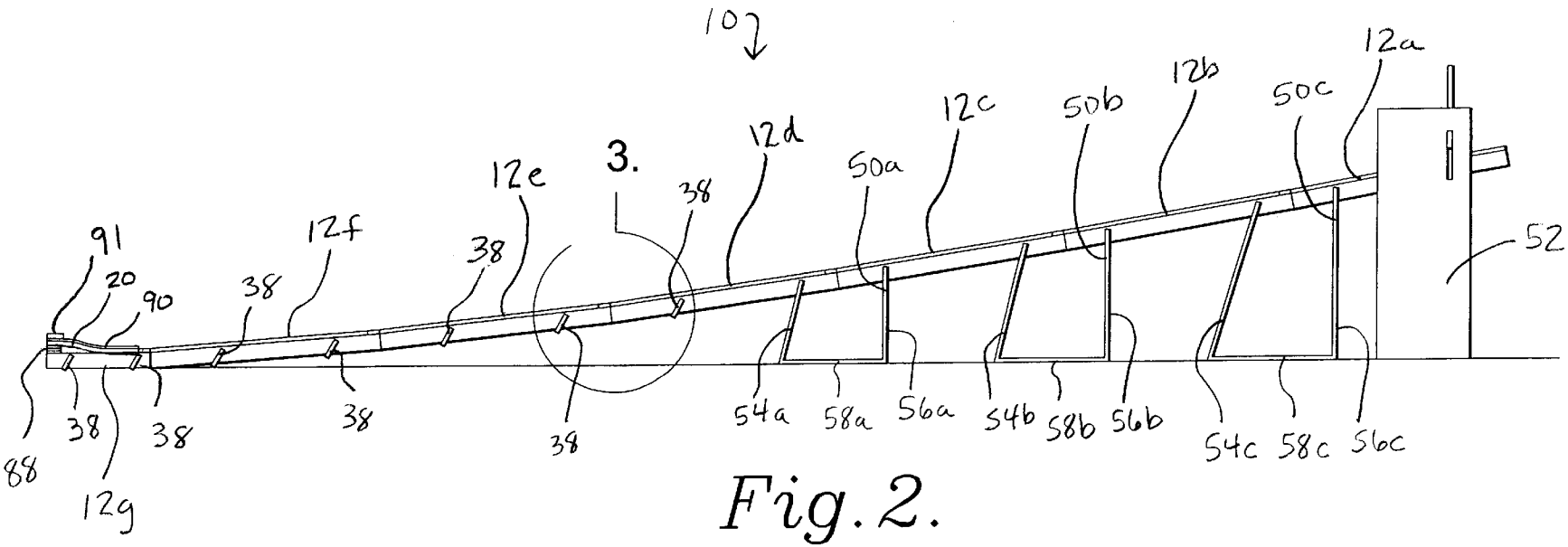
FIG. 2 is a side elevation view of the race track assembly of FIG. 1.

Referring to FIGS. 1 and 2, a race track assembly in accordance with a preferred embodiment of the present invention is represented generally by the numeral 10. Race track assembly 10 includes a plurality of track sections 12 that can be positioned end-to-end to form a race track. In the preferred embodiment, the race track consists of seven track sections 12*a*–12*g* wherein track sections 12*a*–12*f* are each five feet in length and end-run track section 12*g* is two feet in length. The race track has a total length of thirty-two feet, which is the length of a regulation race track for official wooden car derby races sanctioned by the Cub Scouts. Of course, it should be apparent that any number of track sections of different lengths could also be used in accordance with the present invention. Preferably, track sections 12*a*–12*g* are each formed of a lightweight material, such as cardboard or plastic.

Figures 4, 5:
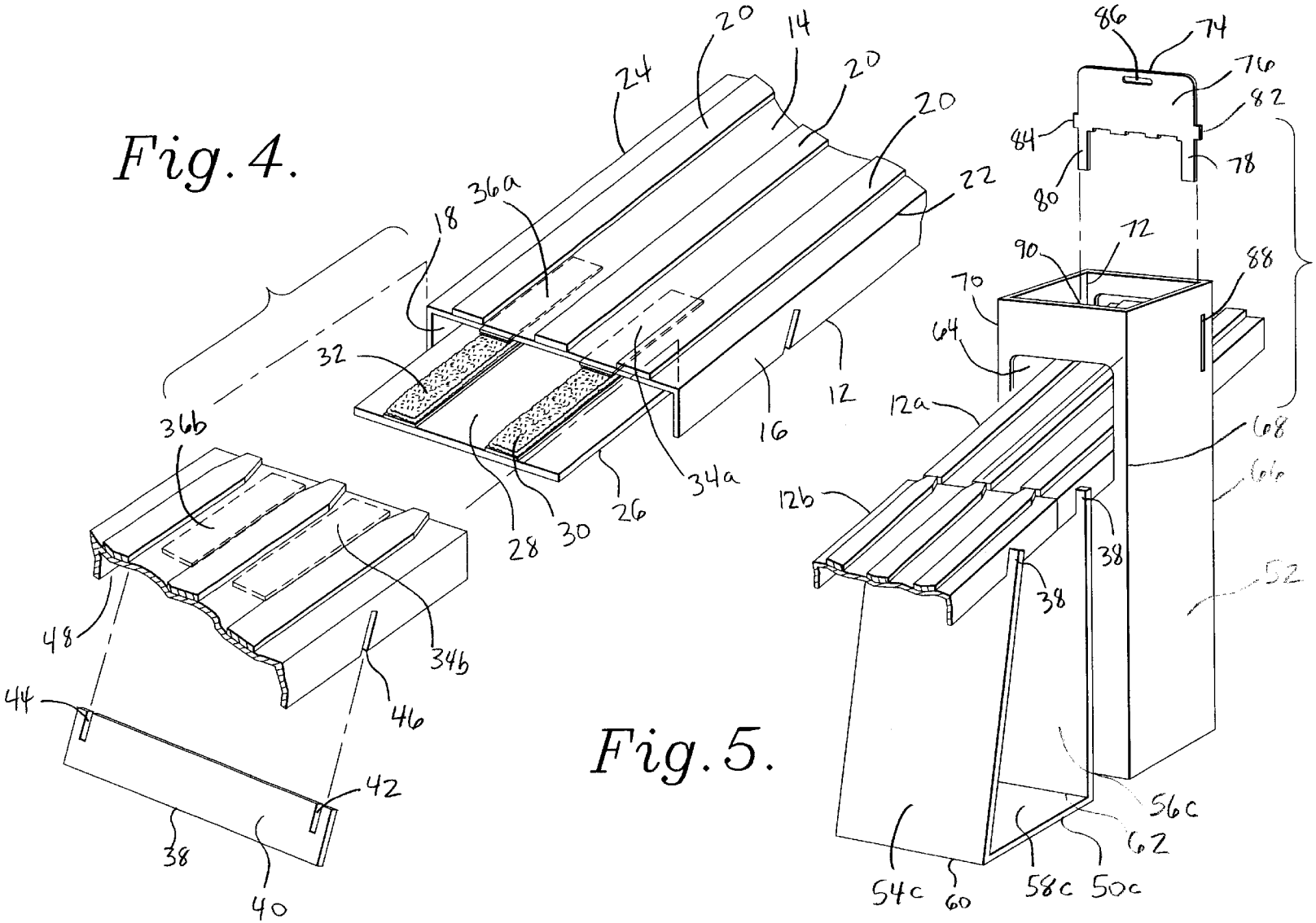
FIG. 4 is an enlarged fragmentary exploded view of the portion of the race track assembly encircled by reference line 4 in FIG. 1.
FIG. 5 is an enlarged fragmentary view of the portion of the race track assembly encircled by reference line 5 in FIG. 1.

As shown in FIG. 4, each track section 12 consists of a main track 14 and two sides 16 and 18 that extend along opposite sides of main track 14. A plurality of raised center pieces 20 are formed on the upper surface of main track 14, each of which serves as a guide for a race car traveling down the race track. In the preferred embodiment, three raised center pieces 20 are provided to accommodate three different race cars. Center pieces 20 keep the race cars on a substantially straight course and prevent the cars from colliding. Of course, it should be apparent that the width of main track 14 could be modified to accommodate a different number of race cars in accordance with the present invention. In the preferred embodiment, each of center pieces 20 is tapered inwardly at the end nearest the upper end of the race track. This configuration allows adjacent track sections 12 to be aligned together in a manner that does not hinder the travel of the race cars from the top end to the bottom end of the race track.

In an important aspect of the present invention, sides 16 and 18 of track section 12 are foldable relative to main track 14 along fold lines 22 and 24, respectively. Initially, sides 16 and 18 are folded outwardly such that track section 12 is in a flat storage configuration. Upon assembly, sides 16 and 18 are unfolded in a downward direction relative to main track 14 to thereby form the sides of the race track. Upon disassembly, sides 16 and 18 can be folded outwardly to return track section 12 to a flat storage configuration.

Figure 3:
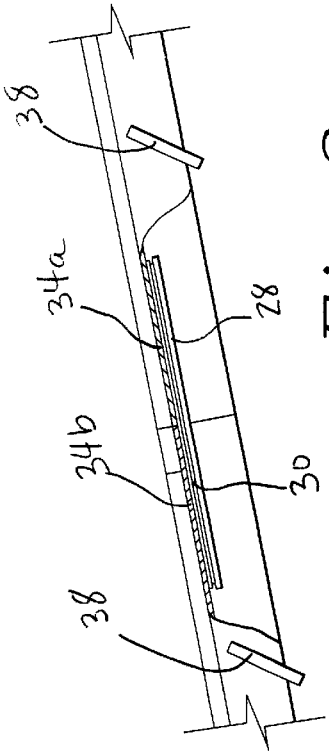
FIG. 3 is an enlarged fragmentary view of the portion of the race track assembly encircled by reference line 3 in FIG. 2.

Referring to FIGS. 3 and 4, race track assembly 10 also includes a plurality of couplers 26 for coupling track sections 12 together. In the preferred embodiment, each coupler 26 includes a coupler panel 28 that is preferably formed of a lightweight material, such as cardboard or plastic. Each coupler also includes two hook-type fasteners 30 and 32 secured to the top face of coupler panel 28, and four loop-type fasteners 34*a*, 34*b*, 36*a* and 36*b* secured to the bottom surfaces of adjacent track sections. Specifically, loop-type fasteners 34*a* and 36*a* are secured to the bottom surface of a first track section, and loop-type fasteners 34*b* and 36*b* are secured to the bottom surface of a second adjacent track section. To couple the adjacent track sections together, hook type fastener 30 are aligned with loop-type fasteners 34*a* and 34*b*, and hook-type fastener 32 are aligned with loop-type fasteners 36*a* and 36*b*. Preferably, the hook-and-loop-type fasteners consist of strips of material sold under the trademark VELCRO®.

It should be apparent that the shape and/or position of the hook-and-loop-type fasteners could easily be modified from that shown in the illustrated embodiment. For example, the loop-type-fasteners could be secured to the top face of coupler panel 28, and the hook-type fasteners could be secured to the bottom surfaces of the adjacent track sections. It should also be understood that other types of couplers could alternatively be used to couple track sections 12 together in accordance with the present invention, such as adhesive strips.

Referring to FIGS. 1, 2 and 4, race track assembly 10 also includes a plurality of cross braces 38 positioned at spaced intervals along the length of the race track and coupled to the track sections 12 in a manner to maintain sides 16 and 18 in a folded configuration. As shown in FIG. 4, each cross brace 38 consists of an elongated body 40 that extends transversely between sides 16 and 18 of track section 12. Two slots 42 and 44 are formed at opposite sides of cross brace 38, which can be mated with two corresponding slots 46 and 48 formed in sides 16 and 18 of track section 12, respectively. Preferably, cross braces are each formed of a lightweight material, such as cardboard or plastic.

As shown in FIGS. 1 and 2, cross braces 38 are attached to track sections 12*d*, 12*e*, 12*f* and 12*g* to maintain the sides of these track sections in a folded configuration (as will be described in greater detail hereinbelow, risers are attached to track sections 12*a*, 12*b*, 12*c* and 12*d* to perform the function of maintaining the sides of these track sections in a folded configuration). As can be seen, track section 12*d* includes two slots located near its bottom end for receiving a cross brace. Track sections 12*e*, 12*f* and 12*g* each includes two slots located near their upper end for receiving a cross brace, and two slots located near their bottom end for receiving another cross brace.

In the preferred embodiment, slots 46 and 48 are formed at an angle between five and fifteen degrees relative to a vertical axis and are angled in an upward direction. This configuration allows each cross brace 38 to be securely attached between sides 16 and 18 so as to maintain sides 16 and 18 in a folded configuration. Of course, the slots could alternatively be formed at a different angle relative to the vertical axis.

While the preferred embodiment shows the use of cross braces 38 to maintain sides 16 and 18 in a folded configuration, other means could alternatively be used for achieving this function. For example, a series of tabs could be used to attach each of sides 16 and 18 to the bottom surface of track sections 12. Other means should be apparent to those skilled in the art.

Referring to FIGS. 1, 2 and 5, race track assembly 10 also includes a plurality of risers 50 for supporting the race track in an inclined position such that the race track extends from a substantially elevated top start end to a bottom finish end that is near the supporting floor. In the preferred embodiment, three risers 50*a*, 50*b* and 50*c* are provided for attachment to track sections 12*a*, 12*b*, 12*c* and 12*d* to support the race track in an inclined position. Each riser 50*a*, 50*b* and 50*c* consists of a first vertical support 54*a*, 54*b* and 54*c*, respectively, and a second vertical support 56*a*, 56*b* and 56*c*, respectively, both of which extend upwardly from a horizontal base 58*a*, 58*b* and 58*c*, respectively. Each vertical support includes two slots formed at the upper end thereof, which can be mated with two corresponding slots formed in sides 16 and 18 of a track section 12. As shown in FIG. 2, the height of risers 50*a*, 50*b* and 50*c* gradually increases in an upward direction so as to provide the proper +slope for the race track. In the preferred embodiment, the race track is formed at a slope of approximately 9 degrees relative to a horizontal axis. Of course, it should be apparent that any number of risers with different varying heights could also be used in accordance with the present invention. Preferably, risers 50*a*, 50*b* and 50*c* are each formed of a lightweight material, such as cardboard or plastic.

In the preferred embodiment, each riser is connected between adjacent track sections so as to provide a stable support for the race track. Specifically, vertical support 54*a* is mated with the two slots located near the upper end of track section 12*d*, and vertical support 56*a* is mated with the two slots located near the lower end of track section 12*c*. Similarly, vertical support 54*b* is mated with the two slots located near the upper end of track section 12*c*, and vertical support 56*b* is mated with two slots located near the lower end of track section 12*b*. In addition, vertical support 54*c* is mated with the two slots located near the upper end of track section 12*b*, and vertical support 56*c* is mated with the two slots located near the lower end of track section 12*a*.

Preferably, the slots located near the upper end of track sections 12*b*, 12*c* and 12*d* (which receive vertical supports 54*c*, 54*b* and 54*a*, respectively) are formed at an angle between five and fifteen degrees relative to the vertical axis. However, the slots located near the lower end of track sections 12*a*, 12*b* and 12*c* (which receive vertical supports 56*c*, 56*b* and 56*a*, respectively) are formed directly along the vertical axis. This configuration provides a stable support for the race track, and, allows the vertical supports of each riser to be constructed of the same length for ease of manufacture. Of course, it should be apparent that the slots could be formed at a different angle relative to the vertical axis in accordance with the present invention.

In an important aspect of the present invention, each of the risers 50*a*, 50*b* and 50*c* are foldable to a flat storage configuration and unfoldable to a track supporting configuration. For example, as shown in FIG. 5, vertical support 54*c* is foldable relative to horizontal base 58*c* along fold line 60, and vertical support 56*c* is foldable relative to horizontal base 58*c* along fold line 62. Initially, vertical supports 54*c* and 56*c* are folded outwardly such that riser 50*c* is in a flat storage configuration. Upon assembly, vertical supports 54*c* and 56*c* can be unfolded in an upward direction relative to horizontal base 58*c* to thereby form riser 50*c*. Upon disassembly, vertical supports 54*c* and 56*c* can then be folded outwardly to return riser 50*c* to a flat storage configuration.

As shown in FIG. 5, another riser 52 is also provided to support the race track in an inclined position. Riser 52 takes the form of a tower consisting of a vertical box having an opening 64 extending through the upper end thereof. As can be seen, opening 64 receives track section 12*a* therethrough to provide additional support for the upper start end of the race track. In an important aspect of the present invention, riser 52 can be folded and unfolded like a box along fold lines 66, 68, 70 and 72. Thus, riser 52 can be folded to a flat storage configuration and unfolded to a track supporting configuration. Preferably, riser 52 is formed of a lightweight material, such as cardboard or plastic.

Riser 52 also includes a starting gate 74 consisting of a main body 76, two legs 78 and 80 extending downwardly therefrom, two tabs 82 and 84 extending from the sides thereof, and a handle 86 formed near the top edge thereof. Tabs 82 and 84 are slideable within slots 88 and 90, respectively, formed in the side walls of riser 52. As a result, starting gate 74 is moveable via handle 86 between a lowered "closed" position for maintaining race cars at the top start end of the race track and a raised "open" position for allowing the race cars to travel toward the bottom finish end of the race track. It should be apparent that when starting gate 74 is moved to the lowered "closed" position, the race track fits into the recessed area located between legs 78 and 80 of starting gate 74.

Referring to FIGS. 1 and 2, race track assembly also includes an elongated piece 88 (preferably formed of cardboard) positioned transversely across the lower end of track section 12*g*. As can be seen, elongated piece 88 maintains the lower end of center pieces 20 at a slightly elevated position so as to form an end ramp for the race cars. For example, center pieces 20 may taper upwardly from 0 inches at the upper end of track section 12*g* to 1½ inches at the lower end of track section 12*g*. Strips 90 (preferably formed of foam) are also attached to the upper surface of center pieces 20 of track section 12*g*, such as with double-sided tape. In order to form a stop for the race cars as they reach the bottom finish end of the race track, blocks 91 (preferably formed of foam) are attached to the upper surface of strips 90 at the lower end of track section 12*g*, such as with double-sided tape.

As will now be described in detail hereinbelow, race car assembly 10 can be assembled from a flat folded configuration for use and returned to a flat folded configuration for storage.

To assemble race car assembly 10, track sections 12*a*–12*g* are positioned end-to-end to form a continuous race track. Preferably, track sections 12*a*–12*g* are positioned in an upside-down configuration to better enable the attachment of couplers 26. Next, the hook-type fasteners 30 and 32 (which are secured to coupler panel 28) are aligned with the loop-type fasteners 34*a*, 34*b*, 36*a* and 36*b* (which are secured to adjacent track sections) to thereby couple the track sections together. Sides 16 and 18 of the track sections are then folded downwardly relative to main track 14 (or upwardly when in the up-side-down configuration).

Next, slots 42 and 44 of cross braces 38 are mated with corresponding slots 46 and 48 formed in sides 16 and 18 of track sections 12*d*–12*g*. Also, the slots of vertical supports 54*a*, 54*b* and 54*c* and vertical supports 56*a*, 56*b* and 56*c* of risers 50*a*, 50*b* and 50*c* are mated with the corresponding slots formed in sides 16 and 18 of track sections 12*a*–12*d*. If the race track was assembled in an upside-down configuration, all of the assembled components are then turned over such that the race track is in an upright configuration. Finally, track section 12*a* is mounted through opening 64 of riser 52 and starting gate 74 is slideably attached within slots 88 and 90 of riser 52.

To disassemble race car assembly 10, the above-described steps are performed in the reverse order. Each of the disassembled components are then returned to the flat folded configuration for storage.

It should be appreciated that a race car participant can easily assemble race car assembly 10 for the purpose of testing the performance of his race car. In addition, race car assembly 10 can be easily disassembled into a small amount of space for storage and/or shipment to a different location via common shipping methods.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in the following claims. Further, it will be understood that certain features and sub-combinations are of utility and may be employed without reference to other features and sub-combinations. This is contemplated by and is within the scope of the claims.

What is claimed and desired to be secured by Letters Patent is as follows:

1. A race track assembly that can be assembled from a flat folded configuration for use and returned to a flat folded configuration for storage, the race track assembly comprising:

a plurality of track sections, each of the track sections comprising a main track and two sides, each of the sides being foldable relative to the main track, and;

a plurality of risers for supporting the track sections in an inclined position to thereby form a race track, the race track extending from a top start end to a bottom finish end, each of the risers being foldable to a flat storage configuration and unfoldable to a track supporting configuration.

2. The race track assembly of claim 1 wherein the track sections and risers are constructed substantially from cardboard.

3. The race track assembly of claim 1 wherein the track sections and risers are constructed substantially from plastic.

4. The race track assembly of claim 1 wherein the track sections and risers can be assembled and disassembled without the use of tools.

5. The race track assembly of claim 1 further comprising a plurality of couplers, wherein each of the couplers includes hook-and-loop fasteners for coupling adjacent track sections together.

6. The race track assembly of claim 1 further comprising a plurality of couplers for coupling the track sections together in an end-to-end relationship, wherein each of the couplers comprises:

a coupler panel;

a hook fastener secured to either the coupler panel or adjacent track sections;

a corresponding loop fastener secured to the other of the coupler panel or adjacent track sections; and wherein the hook fastener can be aligned with the corresponding loop fastener to couple the adjacent track sections together.

7. The race track assembly of claim 1 further comprising a plurality of cross braces positioned at spaced intervals along the length of the race track and coupled to the track sections in a manner to retain the sides in a folded configuration.

8. The race track assembly of claim 7 wherein each of the cross braces includes at least two slots formed therein that can be mated with at least two corresponding slots formed in the sides of the track sections to maintain the sides in a folded configuration.

9. The race track assembly of claim 8 wherein the corresponding slots formed in the sides of the track sections are formed at an angle between five and fifteen degrees relative to a vertical axis.

10. The race track assembly of claim 1 wherein at least one of the risers comprises two vertical supports extending upwardly from a horizontal base to support the race track in an inclined position.

11. The race track assembly of claim 10 wherein each of the vertical supports includes at least two slots formed therein, and wherein the slots of each of the vertical supports can be mated with at least two corresponding slots formed in the sides of the track sections to support the race track in an inclined position.

12. The race track assembly of claim 11 wherein the corresponding slots formed in the sides of the track section that are associated with one of the vertical supports are formed at an angle between five and fifteen degrees relative to a vertical axis.

13. The race track assembly of claim 1 wherein at least one of the risers comprises a tower for supporting the top start end of the race track in an elevated position.

14. The race track assembly of claim 13 wherein the tower comprises a vertical box having an opening for receiving the top start end of the race track.

15. The race track assembly of claim 13 wherein the tower includes a starting gate moveable between a closed position for maintaining race cars at the top start end of the race track and an open position for allowing the race cars to travel toward the bottom finish end of the race track.

16. A race track assembly that can be assembled from a flat folded configuration for use and returned to a flat folded configuration for storage, the race track assembly comprising:

a plurality of track sections positioned end-to-end to form a race track, each track section comprising a main track and two sides, each of the sides being foldable relative to the main track;

a plurality of couplers for coupling the track sections together;

a plurality of risers for supporting the race track in an inclined position such that the race track extends from a top start end to a bottom finish end, each of the risers being foldable to a flat storage configuration and unfoldable to a track supporting configuration; and wherein at least one of the risers comprises a tower for supporting the top start end of the race track in an elevated position.

17. The race track assembly of claim 16 wherein the track sections, couplers and risers are constructed substantially from cardboard.

18. The race track assembly of claim 16 wherein the track sections, couplers and risers are constructed substantially from plastic.

19. The race track assembly of claim 16 wherein the track sections, couplers and risers can be assembled and disassembled without the use of tools.

20. The race track assembly of claim 16 wherein each of the couplers comprises:

a coupler panel;

a hook fastener secured to either the coupler panel or adjacent track sections;

a corresponding loop fastener secured to the other of the coupler panel or adjacent track sections; and wherein the hook fastener can be aligned with the corresponding loop fastener to couple the adjacent track sections together.

21. The race track assembly of claim 16 further comprising a plurality of cross braces positioned at spaced intervals along the length of the race track and extending transversely between the folded sides of the track sections, wherein each of the cross braces includes at least two slots formed therein that can be mated with at least two corresponding slots formed in the sides of the track sections to maintain the sides in a folded configuration, and wherein the corresponding slots formed in the sides of the track sections are formed at an angle between five and fifteen degrees relative to a vertical axis.

22. The race track assembly of claim 16 wherein at least one of the risers comprises two vertical supports extending upwardly from a horizontal base to support the race track in an inclined position.

23. The race track assembly of claim 22 wherein each of the vertical supports includes at least two slots formed therein, and wherein the slots of each of the vertical supports can be mated with at least two corresponding slots formed in the sides of the track sections to support the race track in an inclined position.

24. The race track assembly of claim 23 wherein the corresponding slots formed in the sides of the track section that are associated with one of the vertical supports are formed at an angle between five and fifteen degrees relative to a vertical axis.

25. The race track assembly of claim 16 wherein the tower comprises a vertical box having an opening for receiving the top start end of the race track.

26. The race track assembly of claim 16 wherein the tower includes a starting gate moveable between a closed position for maintaining race cars at the top start end of the race track and an open position for allowing the race cars to travel toward the bottom finish end of the race track.

27. A race track assembly that can be assembled from a flat folded configuration for use and returned to a flat folded configuration for storage, the race track assembly comprising:

a plurality of track sections positioned end-to-end to form a race track, each track section comprising a main track and two sides, each of the sides being foldable relative to the main track;

means for coupling the track sections together;

means for bracing the sides in a folded configuration; and means for supporting the race track in an inclined position such that the race track extends from a top start end to a bottom finish end.

28. The race track assembly of claim 27 wherein the track sections, coupling means, bracing means and supporting means are constructed substantially from cardboard.

29. The race track assembly of claim 27 wherein the track sections, coupling means, bracing means and supporting means are constructed substantially from plastic.

30. The race track assembly of claim 27 wherein each of the track sections, coupling means, bracing means and supporting means can be disassembled into a substantially flat configuration for storage.

31. The race track assembly of claim 27 wherein the track sections, coupling means, bracing means and supporting means can be assembled and disassembled without the use of tools.

32. The race track assembly of claim 27 further comprising a starting gate moveable between a closed position for maintaining race cars at the top start end of the race track and an open position for allowing the race cars to travel toward the bottom finish end of the race track.

33. A method of assembling a race track assembly that is initially in a flat folded configuration, the method comprising the steps of:

(a) positioning a plurality of track sections end-to-end to form a race track, each track section comprising a main track and two sides, each of the sides being foldable relative to the main track;

(b) attaching a plurality of couplers between adjacent track sections to couple the track sections together;

(c) folding the sides of the track sections; and (d) attaching a plurality of risers to the race track to support the race track in an inclined position.

34. The method of claim 33 wherein each coupler comprises a coupler panel, a hook fastener secured to either the coupler panel or adjacent track sections, and a corresponding loop fastener secured to the other of the coupler panel or adjacent track sections, and wherein step (b) includes aligning the hook fastener with the corresponding loop fastener to couple the adjacent track sections together.

35. The method of claim 33 further comprising after step (c) the step of attaching a plurality of cross braces between the folded sides of the track sections to maintain the sides in a folded configuration.

36. The method of claim 35 wherein the cross brace attachment step includes mating two slots formed in each of the cross braces with two corresponding slots formed in the sides of the track sections to maintain the sides in a folded configuration.

37. The race track assembly of claim 33 wherein at least one of the risers comprises two vertical supports extending upwardly from a horizontal base, and wherein step (d) includes mating two slots formed in each of the vertical supports with two corresponding slots formed in the sides of the track sections to support the race track in an inclined position.

38. The method of claim 33 wherein at least one of the risers comprises a tower having an opening extending therethrough, and wherein step (d) includes inserting a top end of the race track through the opening to support the top end of the race track in an elevated position.

39. The method of claim 33 further comprising step (e) of disassembling each of the track sections, couplers and risers into a substantially flat configuration for storage.

40. The method of claim 39 wherein steps (a)–(e) can be performed without the use of tools.

* * * * *